United States Patent [19]

Coope et al.

[11] Patent Number: 4,964,085

[45] Date of Patent: Oct. 16, 1990

[54] NON-CONTACT BOREHOLE CALIBER MEASUREMENT

[75] Inventors: Daniel F. Coope; John E. Fontenot, both of Houston, Tex.

[73] Assignee: Baroid Technology, Inc., Houston, Tex.

[21] Appl. No.: 833,364

[22] Filed: Feb. 25, 1986

[51] Int. Cl.[5] ..... G01V 1/28

[52] U.S. Cl. ..... 367/35; 367/25; 367/27; 324/338

[58] Field of Search ..... 367/25, 27, 35, 86, 367/125, 128; 181/105; 33/302, 303; 166/250; 175/50; 250/266, 264; 324/338, 339

[56] References Cited

U.S. PATENT DOCUMENTS

| | | | |
|---|---|---|---|
| 3,207,256 | 9/1965 | Blizard | 367/25 X |
| 3,330,374 | 7/1967 | Broussard et al. | 367/27 |
| 3,405,349 | 10/1968 | Moran | 324/339 |
| 3,551,979 | 12/1970 | Gouilloud et al. | 324/338 |
| 3,567,936 | 3/1971 | Tittman | 250/264 |
| 3,993,944 | 11/1976 | Meador et al. | 324/339 X |
| 4,035,639 | 7/1977 | Boutemy et al. | 250/264 |
| 4,052,662 | 10/1977 | Rau | 324/338 |
| 4,264,862 | 4/1981 | Koelle et al. | 324/339 |
| 4,300,098 | 11/1981 | Huchital et al. | 324/338 |
| 4,302,722 | 11/1981 | Gianzero | 324/339 |
| 4,303,994 | 12/1981 | Tanguy | 367/35 |
| 4,401,947 | 8/1983 | Cox | 324/339 X |
| 4,492,865 | 1/1985 | Murphy et al. | 250/265 |
| 4,626,785 | 12/1986 | Hagiwara | 324/341 X |
| 4,665,511 | 5/1987 | Rodney et al. | 367/35 |
| 4,744,030 | 5/1988 | Carlson et al. | 367/35 X |

FOREIGN PATENT DOCUMENTS

| | | | |
|---|---|---|---|
| 008992 | 9/1983 | European Pat. Off. | 367/35 |

OTHER PUBLICATIONS

Dresser Atlas Casing Evaluation Services, pp. 4–6 and 61–122, 1985.

*Primary Examiner*—Thomas H. Tarcza
*Assistant Examiner*—Tod Swann
*Attorney, Agent, or Firm*—Browning, Bushman, Anderson & Brookhart

[57] ABSTRACT

A method and apparatus for measuring the caliber of a borehole while drilling utilizes a borehole compensated downhole measuring system in both a compensated and a non-compensated manner. A transmitter of the measuring system generates a signal which is received by at least one spaced receiver with the time/phase relationship of the transmission and reception of the signal at each receiver being indicative of the borehole caliber.

11 Claims, 2 Drawing Sheets

FIG. 1
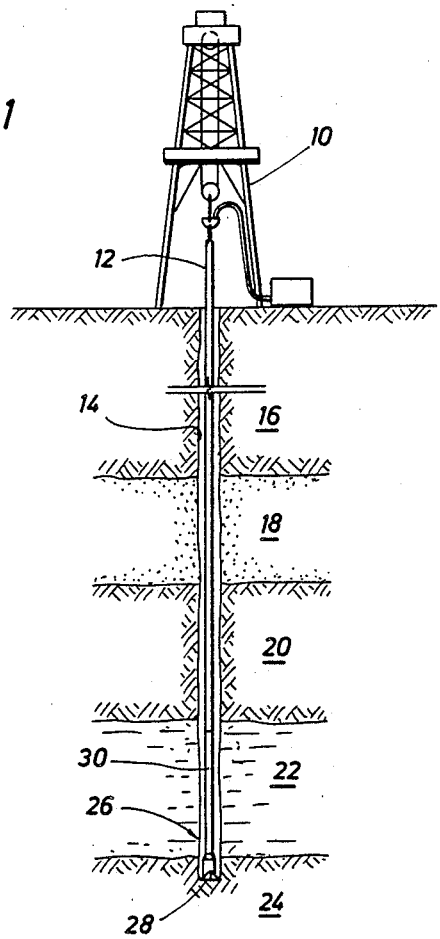
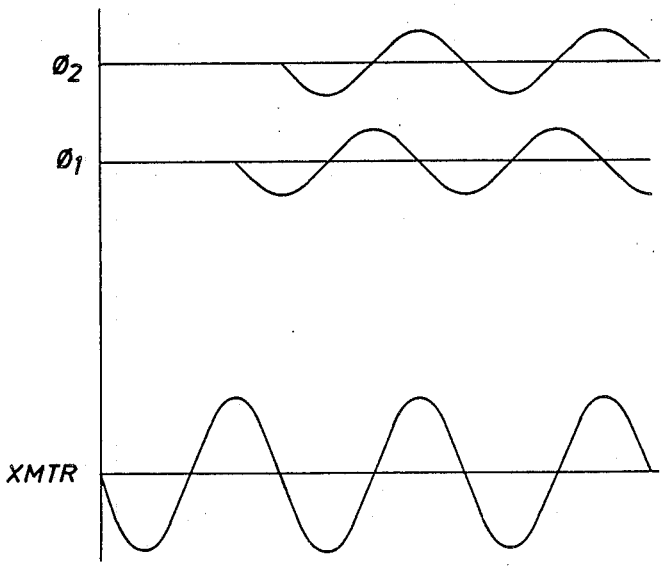
FIG. 3

20
36
RECEIVER DETECTOR
Ø2
34
RECEIVER DETECTOR
Ø1
22
PHASE COMPARATOR
38
TRANSMITTER GENERATOR
32
30
24
28

NON-CONTACT BOREHOLE CALIBER MEASUREMENT

BACKGROUND OF THE INVENTION

1. Field of the Invention

The present invention relates to a method and apparatus for determining average borehole diameter or caliber during a drilling operation, and in particular to a method which can be carried out utilizing any known borehole compensated downhole measurement device.

2. Description of the Prior Art

In any well drilling operation, it is necessary to constantly monitor the condition of the borehole in order to provide early detection of conditions which may require extra steps in order to stabilize the walls of the borehole. For example, a particular formation may have a tendency to swell, which could cause a narrowing of the borehole and possibly the entrapment of the downhole assembly or fracture of the formation face due to excessive bottom pressures. Another example would be a cavity in a formation and which would generate additional debris to be removed from the borehole. Corrective steps which can be taken include modifying the properties of the drilling mud, withdrawing the drill string to rebore a narrowing formation and/or inserting a well casing and filling the annulus between it and the borehole wall with cement to stabilize the borehole. In a cementing operation it is also important to know the diameter of the annulus to be filled so as to determine the volume of cement which will be required and when the cementing operation is completed.

Heretofore, most of the borehole calibration devices have been associated with wireline well logging devices. While many of these provide very accurate borehole calibration, the information is not generated until after the drilling operation has been interrupted, the drill string removed from the borehole and the wireline device lowered downhole. This is a time consuming and expensive operation and points out the need for a method and apparatus for determining the borehole caliber while the drilling operation continues so as to provide the operator with real time information and enabling corrective action to be taken promptly. Many of the above-mentioned wireline devices encounter problems with mud cake, which builds up during the drilling operation, since they require physical contact with the borehole wall, as for example with a six arm caliber or asymmetrically operated devices which actually penetrate the mud cake.

The borehole caliber measurement is utilized in interpreting some well logs and as a correction factor in other well logs, such as nuclear logs, acoustic logs and diameters. Thus, a correct and current measurement of borehole caliber is very important in properly evaluating the potential productivity of the well.

Since there is only a limited amount of room available in a measuring-while-drilling downhole tool, it is important to obtain the maximum amount of information possible with the most efficient utilization of the downhole equipment. The present invention accomplishes this by employing existing downhole measurement devices in a novel manner to make borehole calibration measurements while drilling.

SUMMARY OF THE INVENTION

The present invention utilizes a transmitter and a receiver of a known borehole compensated downhole measurement system to determine the borehole caliber. The system has at least two spaced receivers which receive a reflected signal transmitted from the transmitter and makes measurements according to the phase and/or amplitude difference of the signal received at the receivers. The present invention measures the phase shift between a signal transmitted from the transmitter and its reception at either one of the receivers. The present invention can be utilized with any known borehole compensated downhole measuring system, such as electromagnetic wave resistivity, density, neutron-porosity, acoustic or propagation resistivity logging devices It can be employed in a downhole recording system or in a real-time telemetry-while-drilling system.

BRIEF DESCRIPTION OF THE DRAWINGS

The present invention will now be described by way of example with reference to the accompanying drawings in which:

FIG. 1 is a diagrammatic side elevational view of a typical well drilling operation which would benefit from the present invention;

FIG. 3 is a phase relationship diagram.

DESCRIPTION OF THE PREFERRED EMBODIMENT

Figure 2:
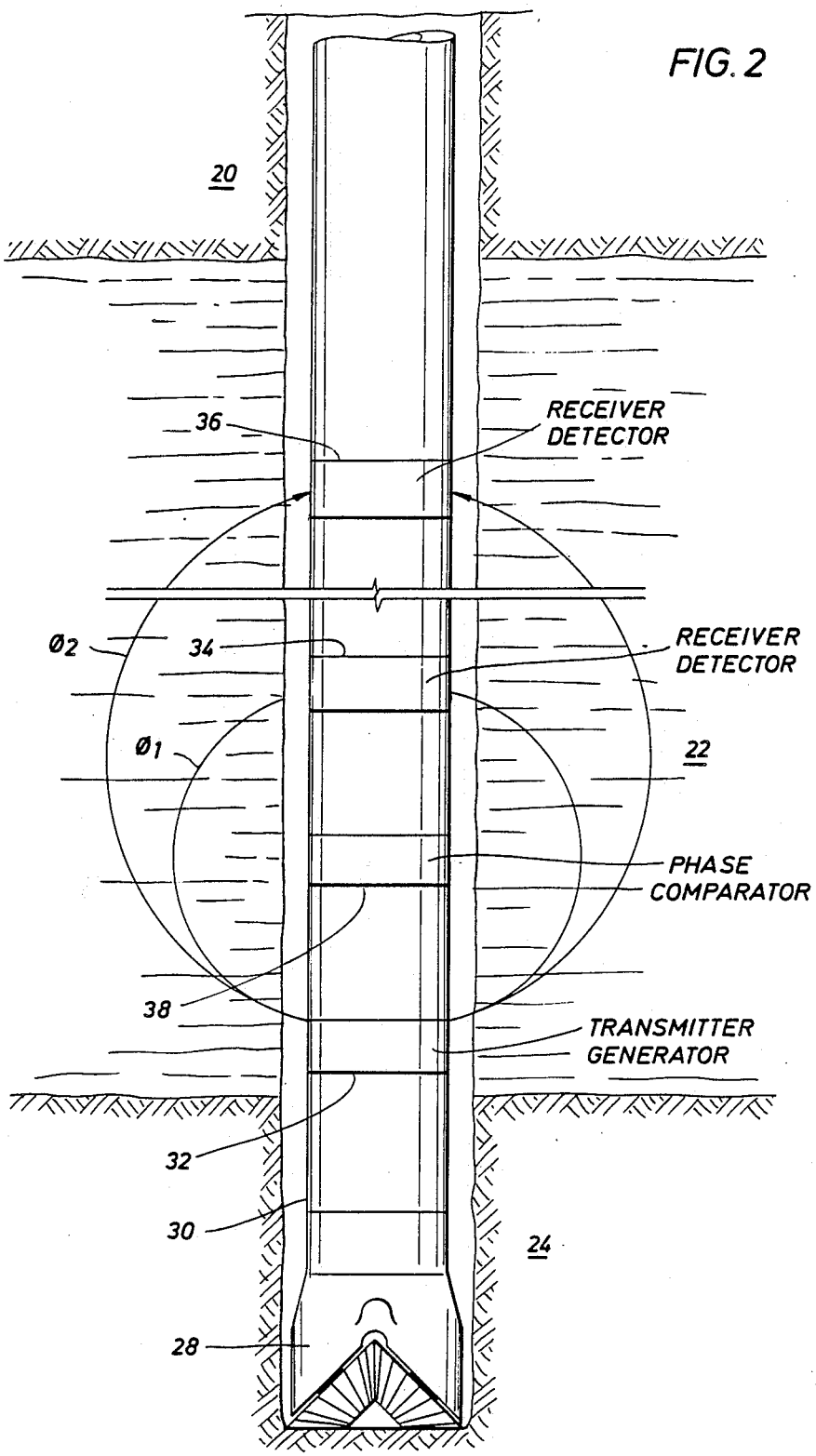
FIG. 2 is a diagrammatic representation, on a larger scale, of an electromagnetic wave resistivity portion of a borehole compensated downhole measurement tool illustrating the principles of the present invention.

The present invention will be described by way of example using an electromagnetic wave resistivity device of a type utilizing the operational principles disclosed in U.S. Pat. Nos. 3,408,561; 3,551,797; and 4,107,598. These patents are distinct in that they relate to wireline devices while the present invention operates while drilling. It should be noted that the present invention could be applied to any borehole compensated downhole measurement device, such as a density, neutron-porosity, acoustic or resistivity device of the electromagnetic wave or propagation resistivity type. The term "borehole compensated measurement device" is intended to include any device wherein a difference is measured as, for example, by a single transmitter sending out a signal which is detected by two or more receivers. It is also well known that the radial investigation of the surrounding formations can be selected in a desired manner by properly selecting the operating frequency and transmitter to receiver spacing.

The present invention will be described with reference to an electromagnetic wave resistivity measuring system, but should be applicable to other borehole compensated type tools, such as density, neutron-porosity and acoustic tools. However, when using different types of tools, factors peculiar to that particular type of tool must be taken into consideration. For example, even though the "signal" is still dependent upon the size of the borehole, it may also depend upon such things as mud density, mud chemistry, salinity, temperature, borehole rugosity, formation lithology, mandrel size and design, etc. Appropriate compensation must be factored into any measurements taken by these tools.

Referring now to FIG. 1, a drilling rig 10 supports a drill string 12 in a borehole 14 which has passed through several formations 16, 18, 20, 22, 24. At the lower end of the drill string 12, there is a downhole assembly 26 including a drill bit 28 and an equipment sub 30. The drilling operation is conventional in that means (not shown) at the surface, such as a kelly and associated equipment, are used to rotate the drill string 12 thereby driving bit 28 with a rotary motion against the lower end of borehole 14. Alternatively, a motor (also not shown) could be attached at the lower end of the drill string to drive the bit. Simultaneously with the bit rotation, drilling mud is pumped down the bore of the drill string 12 and through bit 28 to flow back up the annulus between the drill string and the borehole walls carrying with the mud the debris generated from the drilling operation.

FIG. 1 illustrates different situations which could occur in a borehole. Formations 16 and 20 are fairly hard and stable while formation 18 is soft and could swell to such an extent it could form a constriction, which would prevent withdrawal of the bit 28 and/or possibly jamming the drill string 12 sufficiently to prevent continued rotation. Formation 22 is also soft and could slough in such a manner as to cause a substantial enlargement of the borehole. This would result in additional formation debris being generated which must be removed during the drilling operation. It may be necessary to stabilize a sloughing formation by modifying the properties of the drilling mud or by inserting a casing (not shown) and filling the annulus between the casing and borehole wall with cement. Borehole caliber measurements in such an area would be very important in order to determine the volume of the annulus and thus the quantity of cement required for the cementing operation. This information would also be used to determine when the cementing operation is completed.

The instrument sub 30 illustrated diagrammatically in FIG. 2 includes an electromagnetic wave resistivity tool having a transmitter 32, a pair of receivers 34, 36 spaced from the transmitter and each other, and a phase comparator 38 connected between the transmitter and each receiver. The transmitter generates a signal, a component of which propagates along the borehole and another component of which propagates through the surrounding formation. Two arrows are shown to represent these components of the transmitted signal, but is clearly understood each transmitted signal is three dimensional. Both $\phi_1$ and $\phi_2$ components pass through a portion of the surrounding formation and a portion of the borehole. The phase comparator 38 relates the phase difference $\Delta\phi=\phi_1-\phi_2$ to the formation resistivity $\rho$. Since this is done soon after penetrating the zone, there is usually no flushed zone yet to contend with. For a given mud resistivity, $\rho_m$, and borehole size, $d_h$, there is a unique relationship between $\rho$ and $\Delta\phi$. There is also a relationship among $\phi_1$, $\rho$, $d_h$, and $\rho_m$. When $\rho$ is determined from $\Delta\phi$ and $\rho_m$ is known, it is then possible to determine $d_h$ from a 3-dimensional plot of the phase difference, phases and the resistivity.

The present invention uses the phase $\phi_1$ or $\phi_2$ which is actually the phase difference between the signal transmitted by the transmitter 32 and either one of the spaced receivers 34 and 36. This is, in effect, using a borehole compensated measuring-while-drilling device in an uncompensated manner. The phase comparator 38 would average the phases $\phi_1$ or $\phi_2$ to arrive at a borehole caliber, which would not necessarily be coaxial or concentric with the drill string 12. It would also not indicate the direction of any cavitation from the borehole axis.

Using the above as an example, if a 12 inch borehole washed out to 20 inches, the phase difference ($\Delta\phi$) between the receivers would change only by about 2°, but the phase differential ($\phi_1$ or $\phi_2$) at either receiver from the transmitter would change by about 30°. This would be a strong indication of the presence of a washout. As a comparison, if mud resistivity changed drastically, the phase change between the transmitter and either receiver would only be on the order of 5° to 10°. It is a surprising result that the phase at a single receiver varies widely if the borehole size varies in the range that is expected; but, it does notary significantly for variations in mud resistivity or any of the other things previously discussed if they vary within expected ranges.

The present invention could also be used with an induction process by having a current in a loop generating an induction pulse which would be reflected back creating a current in a second loop acting as a receiver and creating a current therein. Measuring the phase of the induced current would be an indication of the borehole size.

The present invention could be used with other types of compensated logging devices, such as nuclear or acoustic devices. In the case of nuclear devices, count ratios would be used in place of phase difference. In the case of acoustic devices, time difference would be used. The present invention can be used throughout the drilling operation, for example when the drill string is rotating, when the drill string is stopped and raised to add more drill pipe, while lowering the drill string back to the bottom after adding pipe, when tripping the drill string out of the hole to change the bit, and when tripping the drill string back to the bottom. The calibrating information can be transmitted to the surface, by any of the well known means and methods, for immediate use, or it can be recorded downhole for recovery when the drill string is tripped to change the bit. Any of these approaches are possible using state-of-the-art measurement-while-drilling devices. The invention can likewise be applied to a wireline tool to measure borehole caliper after drilling, at least of the section under investigation, has been completed.

The foregoing disclosure and description of the invention is illustrative and explanatory thereof, and various changes in the method steps as well as in the details of the illustrated apparatus may be made within the scope of the appended claims without departing from the spirit of the invention.

What is claimed is:

1. A method for determing changes in the caliber of a borehole utilizing borehole compensated measuring equipment having a transmitter and at least two receivers spaced from said transmitter and from each other, said method comprising the steps of:

transmitting a signal from said transmitter into said borehole, said signal having components reflecting along the borehole walls and components entering the formation;

receiving said signal at each said receiver;

comparing at least one property of said signal received at either of said receivers with said property of the said transmitted signal, whereby said comparison is indicative of changes int eh caliber of said borehole; and generating from only said comparison a log indicative of said changes to thereby provide an indication of changes int he caliber of the borehole.

2. The method according to claim 1, wherein said signals are electrical in nature, and said comparison is performed by comparing the phase of said received signal to the phase of said transmitted signal.

3. The method according to claim 2 further comparing the step of measuring the formation resistivity to determine the absolute diameter of the borehole.

4. The method according to claim 1, wherein said signals are electrical in nature, and said comparison is performed by comparing the amplitude of the said received signal to the amplitude of said transmitted signal.

5. The method according to claim 4 further comprising the step of measuring the formation resistivity to determine the absolute diameter of the borehole.

6. The method according to claim 1, wherein said signals are electrical in nature, and said comparison is performed by comparing the amplitude of said received signal with the amplitude of a reference signal functionally related to the amplitude of said transmitted signal.

7. The method according to claim 6 further comprising the step of measuring the formation resistivity to determine the absolute diameter of the borehole.

8. The method according to claim 1 wherein said method is carried out while drilling.

9. The method according to claim 1 wherein said method is carried out when drilling is briefly interrupted to add pipe to the drill string.

10. The method according to claim 1 wherein said method is carried out while tripping said drill string.

11. A method for determining changes in the caliber of a borehole traversing earth formations, comprising the steps of:

moving through the borehole an array of a transmitting means and a at least one receiving means spaced therefrom;

transmitting electromagnetic energy from said transmitting means into the borehole at a frequency to propagate electromagnetic energy at each said at least one receiving means; and comparing the phase of the electromagnetic energy received at any of said receiving means with the phase of the transmitted energy and generating from only said comparison an output representative of changes in the borehole caliber.

* * * * *

UNITED STATES PATENT AND TRADEMARK OFFICE

CERTIFICATE OF CORRECTION

PATENT NO. : 4,964,085

DATED : October 16, 1990

INVENTOR(S) : Daniel F. Coope; John E. Fontenot

It is certified that error appears in the above-identified patent and that said Letters Patent is hereby corrected as shown below:

In Column 4, line 62, change "int eh" to --in the--.

In Column 4, line 66, change "int eh" to --in the--.

In Column 5, lines 3 and 4, change "comparing" to --comprising--.

Signed and Sealed this

Fourth Day of February, 1992

*Attest:*

HARRY F. MANBECK, JR.

*Attesting Officer*

*Commissioner of Patents and Trademarks*